US009303488B2

(12) United States Patent
Kanstad

(10) Patent No.: US 9,303,488 B2
(45) Date of Patent: Apr. 5, 2016

(54) METHOD AND APPARATUS FOR REMOVING HYDRATE PLUGS

(71) Applicant: FRAMO ENGINEERING AS, Bergen (NO)

(72) Inventor: Stig Kanstad, Bergen (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 14/414,360

(22) PCT Filed: Jul. 9, 2013

(86) PCT No.: PCT/EP2013/064515

§ 371 (c)(1),
(2) Date: Jan. 12, 2015

(87) PCT Pub. No.: WO2014/009385

PCT Pub. Date: Jan. 16, 2014

(65) Prior Publication Data

US 2015/0184490 A1 Jul. 2, 2015

(30) Foreign Application Priority Data

Jul. 13, 2012 (GB) ..... 1212485.5

(51) Int. Cl.

| | |
|---|---|
| ***E21B 37/06*** | (2006.01) |
| ***E21B 36/00*** | (2006.01) |
| ***E21B 41/00*** | (2006.01) |
| ***F28G 9/00*** | (2006.01) |
| ***B08B 9/032*** | (2006.01) |
| ***E21B 43/01*** | (2006.01) |

(52) U.S. Cl.

CPC ..... *E21B 36/00* (2013.01); *B08B 9/0321* (2013.01); *E21B 37/06* (2013.01); *E21B 41/0007* (2013.01); *E21B 43/01* (2013.01); *F28G 9/00* (2013.01)

(58) Field of Classification Search

CPC ..... E21B 37/06; E21B 41/0007
USPC ..... 166/335, 338, 357, 368, 373, 304; 507/90

See application file for complete search history.

(56) References Cited

U.S. PATENT DOCUMENTS

| | | | | |
|---|---|---|---|---|
| 7,569,097 | B2 * | 8/2009 | Campen et al. | 95/243 |
| 7,721,807 | B2 * | 5/2010 | Stoisits et al. | 166/366 |
| 2008/0087328 | A1 * | 4/2008 | Christensen et al. | 137/13 |
| 2010/0012325 | A1 | 1/2010 | Friedemann | |
| 2010/0047022 | A1 * | 2/2010 | Le Moign | 405/184.1 |

(Continued)

FOREIGN PATENT DOCUMENTS

| | | | |
|---|---|---|---|
| GB | 2468920 | A | 9/2010 |
| WO | 2008147217 | A2 | 12/2008 |

(Continued)

OTHER PUBLICATIONS

PCT International Search Report dated May 2, 2014, for International Application No. PCT/EP2013/064515, international filing date Jul. 9, 2013.

*Primary Examiner* — Matthew R Buck
(74) *Attorney, Agent, or Firm* — Conley Rose, P.C.

(57) ABSTRACT

A method for removing hydrate plugs in a hydrocarbon production station, the method comprising: fluidically isolating the production station; diverting production flow to a bypass line; and adjusting the pressure in the production station to a level sufficient to melt the hydrate plugs.

14 Claims, 2 Drawing Sheets

(56) References Cited

U.S. PATENT DOCUMENTS

| | | | | |
|---|---|---|---|---|
| 2010/0193194 | A1* | 8/2010 | Stoisits et al. | 166/335 |
| 2010/0252260 | A1* | 10/2010 | Fowler et al. | 166/275 |
| 2012/0103621 | A1* | 5/2012 | Kanstad et al. | 166/344 |
| 2013/0008517 | A1* | 1/2013 | Murayama | G01N 27/06 137/2 |

FOREIGN PATENT DOCUMENTS

| | | | |
|---|---|---|---|
| WO | 2009042307 | A1 | 4/2009 |
| WO | 2011057369 | A1 | 5/2011 |
| WO | 2012149620 | A1 | 11/2012 |

* cited by examiner

METHOD AND APPARATUS FOR REMOVING HYDRATE PLUGS

CROSS-REFERENCE TO RELATED APPLICATIONS

This application is a 35 U.S.C. §371 national stage application of PCT/EP2013/064515 filed Jul. 9, 2013, and entitled "Method and Apparatus," which claims priority to Application No. GB 1212485.5 filed Jul. 13, 2012, both of which are incorporated herein by reference in their entirety for all purposes.

FIELD OF THE INVENTION

The present invention relates to a method of removing hydrates in oil and gas production flow lines.

BACKGROUND

This summary is provided to introduce a selection of concepts that are further described below in the detailed description. This summary is not intended to identify key or essential features of the claimed subject matter, nor is it intended to be used as an aid in limiting the scope of the claimed subject matter.

In deep sea oil and gas exploration, the formation of hydrates in flow lines can be a serious problem. Hydrates is the common term in the oil and gas industry for water mixed with hydrocarbon gas and liquid substances, which form solids at particular temperatures and pressures above the normal freezing conditions for water. Such hydrate formation tends to result in ice-like plugs which cause reduced or blocked flow in production lines. This reduces productivity and can be dangerous.

Hydrate formation can be reduced using chemical inhibitors such as methanol (MeOH) or mono-ethylene glycol (MEG), and by controlling temperature and pressure to be outside the region in which hydrates are known to form. This generally entails keeping the temperature high, for example by insulation, and the pressure low.

However appropriate conditions for the suppression of hydrate formation cannot always be maintained, particularly in hostile conditions such as deep sea exploration. If hydrates form they can be removed by raising the temperature of the line to melt the hydrate solids, or by decreasing the pressure in the flow lines, for example by bleeding down the lines to melt the hydrate plugs by depressurisation. Trapped gas on either side of a hydrate plug or between multiple plugs may, when the plugs loosen, make the plugs behave as bullets destroying pipe work or equipment. Therefore, both sides of a hydrate plug might be depressurised at the same time. Hence generally the whole flow line is depressurised and bled down. An example of this method is shown in GB 2468920A where the whole production line is depressurised. This is an expensive process because production is effectively stopped during the hydrate removal process, and is much more difficult and expensive for deep sea oil exploration.

Hydrates might form inside pump units, cooling units and recirculation lines and the present invention allows such particular areas of the production line to be targeted for the removal of hydrate plugs, and avoids the disadvantage of draining down the whole line and stopping production.

SUMMARY

According to the present invention there is provided a method for removing hydrate plugs in a hydrocarbon production station, the method comprising: fluidically isolating the production station; diverting production flow to a bypass line; and adjusting the pressure in the production station to a level sufficient to melt the hydrate plugs.

The pressure to melt hydrate plugs in the station will depend on the ambient temperature, and whether hydrate inhibitors are present in the station lines or not. However determination of the melting pressure is within the competency of the skilled man since the conditions for the melting of hydrate plugs are well known to skilled persons in the art.

In one example the pressure would be reduced to around 1 bar or less.

The process fluids in the station might be pushed out into the main production flow line before the pressure in the station is reduced. This may be done by injecting a non-hydrate fluid, for example a hydrate inhibitor such as methanol (MeOH), into the station. For sub-sea production lines this might be done via an umbilical in the riser.

The method may optionally also comprise injecting a chemical hydrate inhibitor into the station flow line.

According to a second aspect of the present invention there is provided apparatus for removing hydrate plugs formed in a flow line of a station of a hydrocarbon production flow line, the apparatus comprising: a plurality of isolation valves arranged to isolate the station from the production flow; a bypass line arranged to divert the production flow away from the station; and means for adjusting pressure in the station to a level sufficient to melt the hydrate plugs.

The apparatus might also comprise at least one hot stab connection point, i.e. an instant and reversible connector inside the station; at least one hot stab connection outside the station; and a jumper connector for connecting the hot stab connections inside the station with the hot stab connections outside the station. An injection port might also be provided to inject a hydrate inhibitor into the station flow line optionally via one of the hot stab connections. A monitor for monitoring the flow of hydrate inhibitor in the station flow line might also be provided.

According to an embodiment the method comprises:

a) injecting a non-hydrate fluid into a station flow line;

b) closing isolation valves in the station to isolate the station flow line from the production line flow line;

c) reducing the pressure inside the station.

The method may be repeated several times to fully remove hydrate plugs.

Before closing the station isolation valves, process fluids in the station may be pushed out into the production flow lines.

Pressurised gas can be used to push non-hydrate fluid into the station, which in turn may push the production fluid out of the station and into the bypass line.

The pressure inside the station may be reduced by reducing a liquid column in the riser, or by replacing liquid with gas and depressurising the gas.

The static pressure inside the station is reduced from deep water pressure substantially down to topside pressure of about 1 bar.

In this manner the driving pressure and displacement fluid might be provided from topside and this makes the process more easily controllable.

In one embodiment, the invention has the advantage of depressurising a subsea station, such as a pumping station or a cooling station, in a production flow line, and thus removing hydrate ice plugs, whilst not interrupting the main production flow.

DETAILED DESCRIPTION OF DRAWINGS

Figure 1:
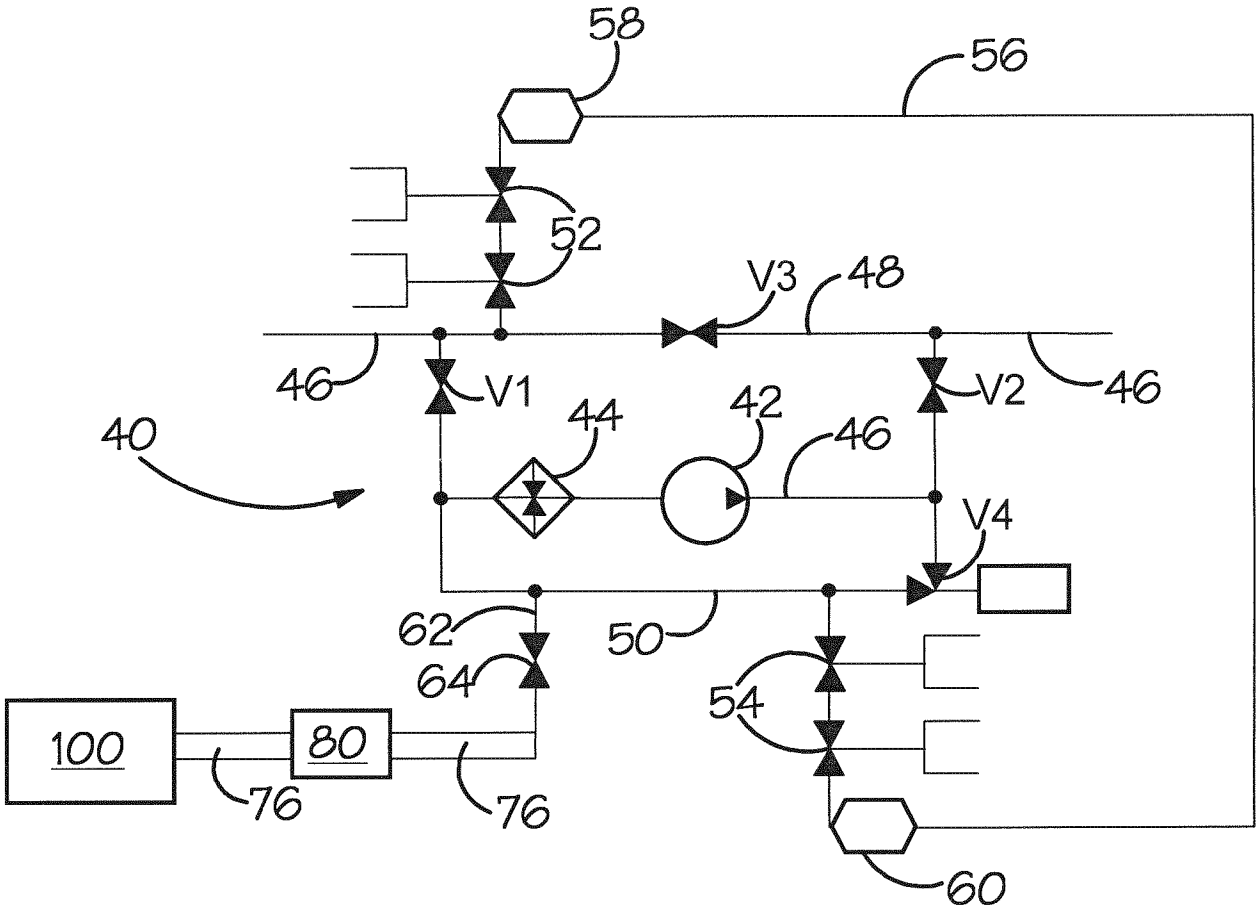
FIG. 1 is a simplified schematic diagram of a subsea compressor pumping station illustrating the invention.

FIG. 1 shows a simplified diagram of a subsea production pumping station 40. A production flow line 46 comprises a subsea cooler unit 44 and a pump/compressor unit 42 located between a first isolation valve V1 and a second isolation valve V2. The isolation valves V1 and V2 control the flow of production fluid through a production flow line 46 via the cooler unit 44 and the pump/compressor unit 42.

A bypass valve V3 controls the flow of fluid through a bypass line 48 which does not flow through the cooler 44 and compressor 42. Flow through a recirculation line 50 is controlled by a recirculation valve V4.

Such a subsea production pumping station is installed in a main production flow line and the flow can be routed through the main flow line 46 through the pumping station, or through the bypass line 48, depending on the settings of the isolation valves V1 and V2 and the bypass valve V3.

In normal operation, the bypass valve V3 is closed and the isolation valves V1 and V2 are open and the production fluid flows through the production flow line 46 and the cooler unit 44 and pump/compressor unit 42.

When the isolation valves V1 and V2 are closed and bypass valve V3 is open then the production flow is diverted to the bypass line 48, and not through the pump/compressor unit 42.

With one or more of the isolation valves V1, V2 closed, and both bypass valve V3 and recirculation valve V4 open, the pump/compressor 42 will be working to recirculate the fluid via the recirculation line 50.

An outer hot stab connection point 58 is connected to the bypass line 48 by hot stab isolation valves 52. An inner hot stab connection point 60 is connected to the recirculation line 50 by hot stab isolation valves 54. A jumper connection line 56 connects the hot stab connection points 58 and 60 to selectively connect the station 40 pressure to the flow line 46 pressure.

An inlet 62 for hydrate inhibitor such as methanol (MEOH) is connected to the recirculation line 50 and controlled by hydrate inhibitor valve 64. The hydrate inhibitor might be supplied from topside, and is bled into or out of the system by a two-way umbilical riser line 76 via a flow meter 80 which can be located topside. In one example, the line 76 connects the station 40 to a topside monitoring or control facility.

To remove a hydrate plug formed inside the pumping station, the below is undertaken:

- The isolation valves V1 and V2 are closed and bypass valve V3 is open. The main production fluid flows through bypass flow line 48.
- Jumper lead 56 is connected between hot stab connection points 58 and 54 to connect the recirculation line 50 in the station 40 to the bypass line 48. Instead of a jumper lead there may also be permanent connections.
- A hydrate inhibitor is injected through an injection port 100 and line 78 into the pumping station 40. This may be injected from topside via an injection column in a riser umbilical. This pushes the process fluid (hydrocarbons including gas, oil and water mixtures) that were in the pumping station 40 out into the main production flow 46 line and production flow is maintained and no production fluid is lost.
- The hydrate inhibitor may be methanol (MeOH) or might be another fluid (gas or liquid). It might be pushed into the station 40 by pressurised gas. Using a non hydrate forming gas can make depressurization easier as there is no liquid column in the umbilical/down line.
- Injection of the methanol is stopped when all or a portion of the process fluids have been pushed out of the station 40. The station isolation valves V1 and V2 are then closed to isolate the station 40 from the production flow line 46 and the bypass valve V3 is opened to divert the production flow through the bypass line 48.
- The methanol is then bled back towards topside via line 76 and port 100 until the pressure inside the station 40 is generally equal to the static pressure in the umbilical.
- The pressure inside the station 40 is then reduced. This may be by depressurising gas in the umbilical riser line 76 or gas lifting a liquid riser column by venting the pressurised gas in the riser line 76 to atmosphere at topside. This reduces the pressure in the riser line 76 and thus in the station 40 towards 1 bar, which might be sufficient to melt hydrates at ambient temperatures at around 4° C., as in some examples of sub-sea conditions. A piston may be pushed down the umbilical. This will force liquid in the umbilical to flow out of the umbilical. Removing the piston will then reduce the height of the static column (not allowing liquid to flow back into the riser again) hence reducing static pressure. A coil tubing could be inserted. It will, when inserted act in the same manner as a piston. However, compressed gas can be sent down the coiled tube. The gas will then flow back towards topside in an annulus between the coiled tube and the umbilical wall. The liquid in the annulus will then be brought to topside together with the gas. This will bring the pressure further down towards 1 bar when depressuring the gas after removing the liquid.
- The expansion of the methanol inside the station 40 causes a back flow into the riser line 76. Further backflow in the riser line 76 is caused by gas produced by hydrates melting in the station.

The benefits of such a method increase with increasing water depths, since this increases pressures and decreases temperatures and makes hydrate plug formation more common.

The arrangement including the hot stab connection point 62, the bypass line 48 and the valves, can also be used to displace fluids in the pumping station 40 prior to intervention such as repair or servicing of the station.

The flow meter 80 might be installed either topside or in the umbilical to monitor the hydrate inhibitor flow rate and the pressure of fluids being injected into or bled off from the umbilical. The hydrate inhibitor may be diverted to a flare to burn off any backflowing hydrocarbons which could otherwise be dangerous or unacceptable if received topside, for example on the deck of a topside vehicle. In some embodiments, excess pressure can be bled to a low pressure tank or accumulator or similar.

Alternative hydrate inhibitors to methanol could be used and the displacement fluid could be compressed gas or other liquids and not necessarily hydrate inhibitor, or it could be a mixture of a hydrate inhibitor and another fluid. The flow lines for the fluid displacement could be permanent dedicated lines or could be separate temporary down lines. Separate lines may be provided for depressurising the station 40, e.g. dedicated gas filled pressure lines.

As the hydrate plugs begin to melt, the pressure inside the pumping station will tend to rise and it may therefore be advantageous to repeat the process several times. However, the process fluid flow is not interrupted so this does not cause a disadvantage.

The high concentration of hydrate inhibitor in the subsea station during the procedure assists in inhibiting and preventing further hydrate formation.

Figure 2:
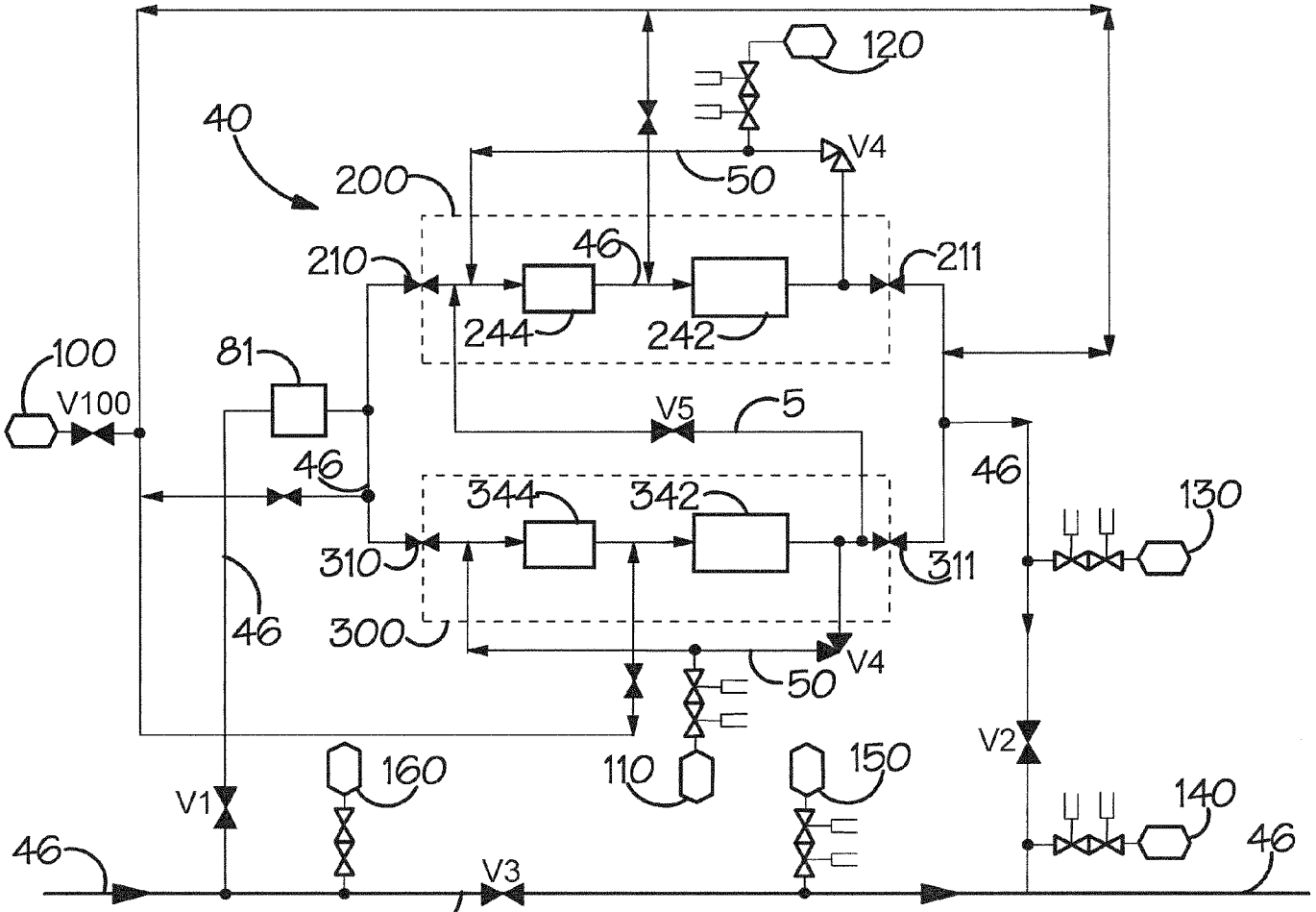
FIG. 2 illustrates the invention in more detail.

FIG. 2 illustrates the invention in more detail and like features are indicated by like reference numbers.

In FIG. 2, a production station 40 is shown with two cooler-compressor units 200 and 300. Each unit has a cooler 244, 344 and a compressor 242, 342 and a respective compressor isolation input valve 210 and 310 and compressor isolation output valve 211 and 311. They are connected by connection line 5 and a connector valve V5 controls whether the units 200 and 300 are connected for parallel or serial compression. If V5 is closed then the units 200 and 300 operate in parallel. If V5 is open, and both input valve 210 and output valve 311 are closed then the units 200 and 300 operate to provide serial compression.

Production fluid is supplied to the compressor units 200 and 300 via production flow line 46 and flow mixer 81. Methanol or other hydrate inhibitor fluid is supplied via port 100 and its supply is controlled by valve V100. Bleed off from the recirculation lines 50 is via ports 110, 120. Bleed off from the production flow line 46 inside the station 40, i.e. on the station side of the isolation valve V2, is via port 130. Bleed off outside the station is via port 140, which is located on the bypass side of the isolation valve V2 and may displace fluid and relieve the pressure in a larger section of the station. Further bleed off ports 150, 160 may be provided (as shown) in the bypass line 48 on each side of the bypass valve V3. Many alternative or additional positions for ports may be used. Ports may be connected permanently or by jumper leads. The ports may be hot stab connection ports or other suitable connectors.

If hot stab connectors or jumpers are not provided to allow fluid displacement across isolation valves prior to depressurization then displacement of the production fluid in the station may be by pushing the hydrocarbons out of the station though V1 or V2 prior to depressurization.

The invention claimed is:

1. A method for removing hydrate plugs in a hydrocarbon production station, the method comprising:

fluidically isolating the production station;

diverting production flow to a bypass line; and reducing the pressure in the production station to a level sufficient to melt the hydrate plugs by depressurizing an injection line until the static pressure inside the production station is reduced substantially to ambient pressure, the injection line being configured to inject a non-hydrate fluid into the production station.

2. The method according to claim 1 wherein the pressure in the production station is reduced to around 1 bar or less.

3. The method according to claim 1 comprising pushing process fluids in the production station out into a production flow line connected to the production station before the pressure in the production station is reduced.

4. The method according to claim 3 comprising injecting the non-hydrate fluid into the production station to push the process fluid into the production flow line.

5. The method according to claim 4 wherein the non-hydrate fluid is a hydrate inhibitor.

6. The method according to claim 5 wherein the non-hydrate fluid is methanol.

7. The method according to claim 4 wherein the non-hydrate fluid is injected via an umbilical in a riser.

8. The method according to claim 1 further comprising:

a) injecting the non-hydrate fluid into a station flow line connected to the production station;

b) closing isolation valves in the production station to isolate the station flow line from a production flow line connected to the production station;

c) reducing the pressure inside the production station.

9. The method according to claim 3 wherein a pressurized gas is used to push the non-hydrate fluid into the production station, which in turn pushes the process fluids out of the production station and into the bypass line.

10. An apparatus for removing hydrate plugs formed in a flow line of a station of a hydrocarbon production flow line, the apparatus comprising:

a plurality of isolation valves arranged to isolate the station from a production flow;

a bypass line arranged to divert the production flow away from the station; and an injection line coupled to the station and configured to inject a non-hydrate fluid into the station, wherein a pressure in the station is reduced to a level sufficient to melt the hydrate plugs as a result of the injection line being depressurized.

11. The apparatus according to claim 10 comprising:

a first hot stab connection point inside the station;

a second hot stab connection outside the station; and a fluid pathway that connects the hot stab connection inside the station with the hot stab connection outside the station.

12. The apparatus according to claim 10 wherein the non-hydrate fluid is a hydrate inhibitor, the apparatus further comprising an injection port to inject the hydrate inhibitor into the station flow line.

13. The apparatus according to claim 11 wherein the non-hydrate fluid is a hydrate inhibitor, the apparatus comprising a hot stab connection port to inject the hydrate inhibitor via one of said first or second hot stab connections.

14. The apparatus according to claim 12 further comprising a flow meter configured to monitor a flow of the hydrate inhibitor in the station flow line.

* * * * *